US005814116A

United States Patent [19]

Schneider et al.

[11] Patent Number: 5,814,116

[45] Date of Patent: Sep. 29, 1998

[54] ARRANGEMENT FOR GENERATING A PURIFIED, LOW-TURBULENCE AIR FLOW FOR SUPPLYING LOCAL CLEAN ROOMS

[75] Inventors: Heinz Schneider; Klaus Schultz, both of Jena, Germany

[73] Assignee: Jenoptik Aktiengesellschaft, Jena, Germany

[21] Appl. No.: 663,486

[22] Filed: Jun. 13, 1996

[30] Foreign Application Priority Data

Oct. 13, 1995 [DE] Germany ..... 195 38 040.1

[51] Int. Cl.[6] ..... B01D 46/00

[52] U.S. Cl. ..... 55/385.2; 55/470; 55/473

[58] Field of Search ..... 55/385.2, 470, 55/473, 502, DIG. 18

[56] References Cited

U.S. PATENT DOCUMENTS

| | | | |
|---|---|---|---|
| 3,251,177 | 5/1966 | Baker | 55/DIG. 18 |
| 3,284,148 | 11/1966 | Ramniceanu | 55/385.2 |
| 3,290,866 | 12/1966 | Schonrock | 55/470 |
| 3,301,167 | 1/1967 | Howard et al. | 55/473 |
| 3,838,556 | 10/1974 | Finger | 55/473 |
| 3,935,803 | 2/1976 | Bush | 55/473 |
| 5,053,065 | 10/1991 | Garay et al. | 55/385.2 |
| 5,425,793 | 6/1995 | Mori et al. | 55/385.2 |

FOREIGN PATENT DOCUMENTS

| | | | |
|---|---|---|---|
| 988357 | 5/1976 | Canada | 55/385.2 |
| 3513902 | 10/1985 | Germany . | |
| 21 38 985 | 2/1993 | Germany . | |
| 43 03 805 A1 | 9/1993 | Germany . | |
| 42 38 895 C1 | 12/1993 | Germany . | |
| 4236031 | 4/1994 | Germany . | |
| 50140091 | 5/1974 | Japan . | |
| 51136570 | 4/1975 | Japan . | |
| 52-142851 | 11/1977 | Japan . | |
| 61-71829 | 5/1986 | Japan . | |
| 61-175834 | 11/1986 | Japan . | |
| 2-183832 | 8/1987 | Japan . | |
| 64-75835 | 3/1989 | Japan . | |

OTHER PUBLICATIONS

"Reine Arbeitszonen," catalogue of Babcock GmbH, 27 Jan. 1992 (stamped date).

"Grundlagen reinraumtechnischer Einrichtungen" by Herbert Eidam, from the periodical *Technische Rundschau,* 25/89, pp. 38 to 43.

*Primary Examiner*—C. Scott Bushey

*Attorney, Agent, or Firm*—McAulay Nissen Goldberg Kiel & Hand, LLP

[57] ABSTRACT

An arrangement for generating a purified, low-turbulence air flow for supplying local clean rooms is aimed to reduce the constructional depth of an air processing installation and, in addition, to extensively prevent the transmission of vibrations from the air flow-generator to the equipment unit to be supplied. The wall of the plenum chamber located opposite an outlet opening in the plenum chamber adjoins a filter accommodated in a plenum chamber at the side for the inlet of unpurified air. A space remains open between the wall and the filter. This space communicates with the rest of the space in the plenum chamber and serves primarily to form the plenum. The arrangement is applicable in the manufacturing of integrated circuits.

6 Claims, 1 Drawing Sheet

ARRANGEMENT FOR GENERATING A PURIFIED, LOW-TURBULENCE AIR FLOW FOR SUPPLYING LOCAL CLEAN ROOMS

BACKGROUND OF THE INVENTION a) Field of the Invention

The invention is directed to an arrangement for generating a purified, low-turbulence air flow for supplying local clean rooms in which a fan and a filter which has one side for the inlet of unpurified air and an opposite side for the outlet of the purified air flow are enclosed by walls of a plenum chamber, with an inlet opening in one of the walls, the fan being connected to the inlet opening for sucking in air, and with an outlet opening in another wall, the filter contacting the latter by the side for the outlet of the purified air flow.

b) Description of the Related Art

Technical solutions of this kind are applicable in the production of integrated circuits and are known, for example, from DE 35 13 902 A1.

As a result of diminishing structural widths and the demand for increased productivity, requirements for clean room conditions in the environment surrounding the objects to be processed are steadily increasing. The introduction of new technology, e.g., the use of SMIF (standard mechanical interface) systems, is tied to the use of local clean rooms which are coupled to the various equipment units. The transition from large clean rooms, in which a vertical laminar flow of air serves to maintain clean room conditions, to small local clean rooms which often operate with a horizontal laminar air flow, leads to excessive equipment dimensions when the known technical solutions are used.

While air processing installations comprising filters and fans were conventionally arranged at the ceiling or above the equipment unit for the purpose of generating vertical air flows, local horizontal air flows require that they be integrated in the equipment. This often results in increased floor space requirements.

For the purpose of processing air, the solution disclosed in DE 35 13 902 A1, for example, makes use of a centrifugal fan which is integrated in the plenum, its air being delivered, in its entirety, parallel to the surface of the filter elements. Deflecting surfaces surrounding the centrifugal fan generate an air flow from the edge surfaces to the center of the filter.

In DE 42 36 031 A1, the inlet opening and axial fan are separated by a tubular housing from the plenum to an air outlet in the direction of flow in order to increase efficiency by means of a low-turbulence uniform flow of air against the filter surface. Air deflecting plates inserted in the air flow counteract rotational air flow components.

Aside from the fact that the constructional depth in both of these solutions is too great for many applications, the use of air deflection plates adds considerably to the cost of design and manufacture, since sufficient stability of the air deflecting devices must be achieved in order to prevent vibrations on the one hand and because of the additional noise generated at the breakaway edges of the air deflection plates on the other hand. The partial reduction in constructional depth achieved through the use of axial fans instead of radial fans is generally tied to an increased noise level which naturally has a disturbing effect on the operator.

A further disadvantage consists in the possible transmission of vibrations as a result of coupling the air processing installations to the equipment units as is conventional in local clean rooms. The transmission of vibrations has a particularly negative effect on image-generating or image-processing equipment. Operation with this equipment cannot be guaranteed without costly steps for vibration isolation with problems of coupling to the housing of the equipment unit and separating the surroundings from the enclosed clean room.

OBJECT AND SUMMARY OF THE INVENTION

Therefore, a primary object of the present invention is to effect a further reduction of the constructional depth of the air processing installation and, in addition, to extensively prevent by simple means the transmission of vibrations from the air flow-generating means to the equipment unit to be supplied.

By means of an arrangement for generating a purified, low-turbulence air flow for supplying local clean rooms in which a fan and a filter which has one side for the inlet of unpurified air and an opposite side for the outlet of the purified air flow are enclosed by walls of a plenum chamber, with an inlet opening in one of the walls, the fan being connected to the inlet opening for sucking in air, and with an outlet opening in another wall, the filter contacting the latter by the side for the outlet of the purified air flow, this object is met in that the wall of the plenum chamber located opposite the outlet opening is adjacent to the side for the inlet of the unpurified air and leaves open a space which communicates with the rest of the space in the plenum chamber.

The fan is adjacent to the filter in a direction vertical to the direction of the purified air flow.

Instead of using one fan, at least a pair of fans can also be adjacent to the filter in a direction vertical to the direction of the purified air flow. If two or more fans are used, the space left open at the side for the inlet of unpurified air is advantageously divided into partial spaces corresponding to the quantity of fans, these partial spaces being formed by the wall of the plenum chamber and portions of the side for the inlet of unpurified air, wherein the division is omitted at the side for the outlet of the purified air flow.

In order to prevent the transmission of vibrations from the means generating the flow of air to the equipment unit to be supplied, holding and fastening elements which are fastened at a base frame outside the plenum chamber such that they emerge from the plenum chamber so as to be sealed and isolated relative to vibrations are advantageously arranged at each fan. At the same time, the base frame can serve as a support for the equipment unit containing the local clean room, a vibration isolation system being provided between the base frame and the equipment unit.

This arrangement enables the vibration isolation of the fan relative to the local clean room and the structural units arranged therein without great expenditure and the free space which is required because of relative movements of the portion of equipment which is isolated relative to vibrations can be provided without a geometric increase in the filter-fan unit.

The invention will be explained more fully in the following with reference to the schematic drawings.

DESCRIPTION OF THE PREFERRED EMBODIMENTS

Figure 1:
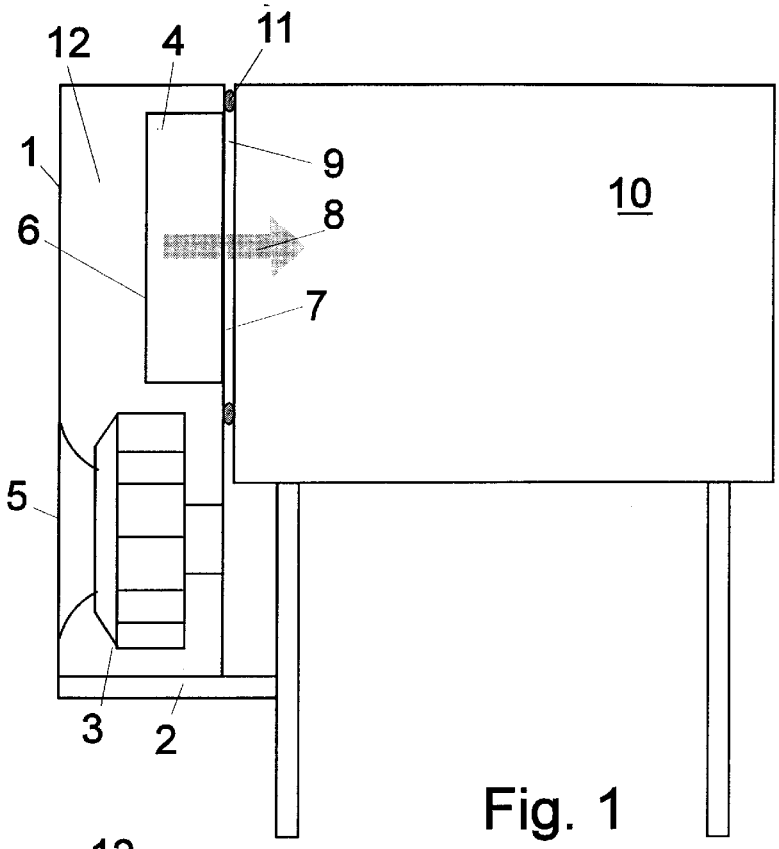
FIG. 1 shows a filter-fan unit coupled to an equipment unit with a local clean room.

According to FIG. 1, the walls of a plenum chamber 1 enclose a fan 3 and a high-efficiency particulate air filter 4, the plenum chamber 1 being supported by a base frame 2. The plenum chamber 1 is hermetically sealed relative to the surrounding environment as far as the inlet opening 5 in one of the walls. The fan 3 is connected to this inlet opening 5 which enables air to be supplied from the surrounding space. The high-efficiency particulate air filter 4 has a side 6 for the inlet of unpurified air and an opposite side 7 for the outlet of a purified air flow 8 encloses an outlet opening 9. Accordingly, the purified air can enter an equipment unit 10, which serves to produce and maintain a local clean room and which is coupled with the plenum chamber 1 via sealing elements 11, only via the high-efficiency particulate air filter 4 corresponding to its filtration efficiency.

The arrangement of the fan 3, which is designed in this embodiment example as a radial fan, is effected, as is conventional, in a direction vertical to the direction of the purified air flow 8 adjacent to the high-efficiency particulate air filter 4 in order to reduce the constructional depth of the filter-fan unit. The wall of the plenum chamber 1 located opposite the outlet opening 9 leaves open a space 12 at the side 6 for the inlet of the unpurified air, this space 12 communicating with the rest of the space in the plenum chamber 1. The opened space 12 is the region of the plenum chamber 1 which, as the retaining space, serves primarily to form the plenum so as to ensure a locally extensively uniform flow through the high-efficiency particulate air filter 4 and consequently a low-turbulence displacement flow at the pure-air side outlet of the purified air flow 8.

The features defining the constructional depth are the thickness of the high-efficiency particulate air filter 4 and the required breadth of the space 12 which must be so dimensioned that the characteristics of a plenum are retained. A reduction of up to 40% compared with conventional arrangements is possible.

By suitably selecting the fan and filter, whose dimensions and geometry can be adapted to the requirements of the local clean room, the filter-fan unit can be varied within wide limits.

Figure 2:
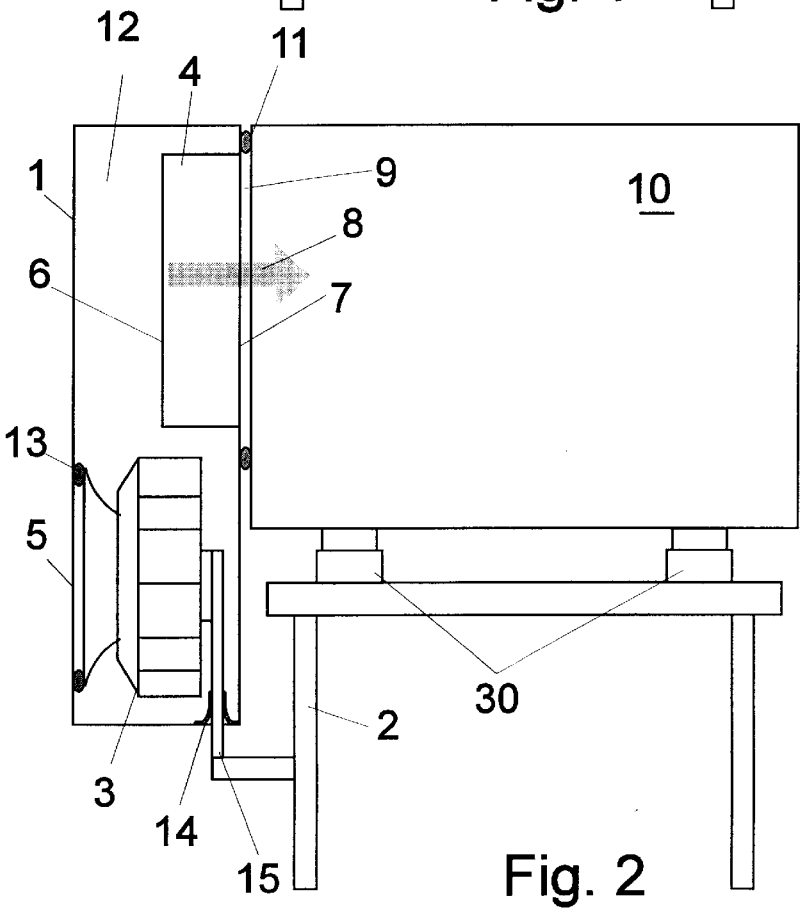
FIG. 2 shows a filter-fan unit with a vibration-isolated coupling to the equipment unit with the local clean room.

In the construction according to FIG. 2, the fan 3 is separated from the walls of the plenum chamber 1 with respect to vibrations. For this purpose, there are provided vibration-damping sealing elements 13 at the inlet opening 5 and an outlet 14 of a holder 15 for the fan 3, which holder 15 is fastened to the base frame 2, this outlet 14 being isolated against vibrations and being airtight relative to the surroundings so as to prevent pressure loss. In the region of the outlet opening 9, the filter-fan unit is connected with the equipment unit 10 directly or via sealing elements 11. The equipment unit 10 comprises its own vibration isolation system 30 which is supported on the base frame 2.

Figure 3:
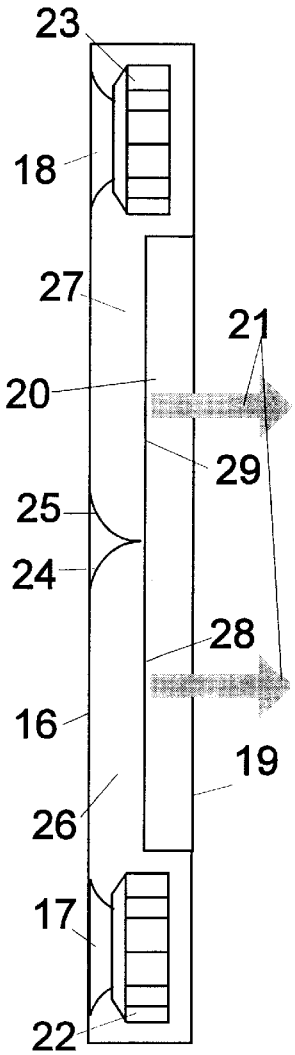
FIG. 3 shows a filter-fan unit with a pair of fans.

In the construction according to FIG. 3, a pair of fans 22, 23 adjoins a filter 20 in a direction vertical to the direction of a purified air flow 21 in a plenum chamber 16 with inlet openings 17, 18 and an outlet opening 19. The air sucked in by each fan 22, 23 is directed to partial spaces 26, 27 which are separated by dividing walls 24, 25 and are formed by the wall of the plenum chamber 16 and portions 28, 29 of the side for the inlet of unpurified air. In this arrangement, which need not be limited to a pair of fans, each fan generates its own plenum. Since there is no need for a separation on the pure-air side, an individual laminar, low-turbulence flow is produced.

While the foregoing description and drawings represent the preferred embodiments of the present invention, it will be obvious to those skilled in the art that various changes and modifications may be made therein without departing from the true spirit and scope of the present invention.

What is claimed is:

1. An arrangement for generating a purified, low-turbulence air flow for supplying a local clean room, comprising:

a chamber defining a room provided for generating a plenum and which is housed by walls, said walls including a pair of parallel first and second walls, said chamber having an inlet opening in the first wall serving as an inlet of ambient unpurified air into the room and an outlet opening in the second wall serving as an outlet of air from the room to the local clean room;

a fan disposed in the chamber and being connected to said inlet opening in the first wall for drawing in ambient unpurified air therethrough;

a filter disposed in the chamber and having a first filter side provided for the outlet of the purified air flow and contacting the outlet opening in said second wall, said filter having a second filter side disposed adjacent to said first wall located opposite to the outlet opening, a space between said first wall and said second filter side serving as a retaining space and being in communication with the rest of the room; and holding and fastening elements for fastening said fan to a base frame located outside the plenum chamber, said holding and fastening elements including means for vibrationally isolating said fan from said filter by emerging from the plenum chamber without being supported by the walls of the plenum chamber.

2. The arrangement according to claim 1, wherein said fan is adjacently disposed to said filter in a direction perpendicular to the direction of the purified air flow.

3. The arrangement according to claim 2, further comprising at least one additional fan adjacently disposed to the filter in a direction perpendicular to the direction of the purified air flow.

4. The arrangement according to claim 3, wherein the space left open at the side for the inlet of unpurified air is divided into partial spaces corresponding to the quantity of fans, said partial spaces being formed by the wall of the plenum chamber and portions of the side for the inlet of unpurified air, wherein the division is omitted at the side for the outlet of the purified air flow.

5. The arrangement according to claim 1, wherein the base frame serves at the same time as a support for the equipment unit containing the local clean room, a vibration isolation system being provided between the base frame and the equipment unit.

6. The arrangement of claim 3, wherein said fan is disposed adjacent to a third side of said filter, and said one additional fan is disposed adjacent to a fourth side of said filter, said third and fourth sides of said filter being parallel and arranged on opposite sides of said filter.

* * * * *